US010513672B2

(12) United States Patent
Galimi, II et al.

(10) Patent No.: US 10,513,672 B2
(45) **Date of Patent: *Dec. 24, 2019**

(54) PRODUCT FOR CLEANING SURFACES

(71) Applicant: Joseph M. Galimi, II, Ellijay, GA (US)

(72) Inventors: Joseph M. Galimi, II, Ellijay, GA (US); Ronald Jones, Charleston, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/276,409

(22) Filed: Sep. 26, 2016

(65) Prior Publication Data

US 2017/0009185 A1 Jan. 12, 2017

Related U.S. Application Data

(63) Continuation of application No. 14/180,682, filed on Feb. 14, 2014, now Pat. No. 9,476,014.

(60) Provisional application No. 61/764,654, filed on Feb. 14, 2013.

(51) Int. Cl.

| | |
|---|---|
| ***C11D 7/12*** | (2006.01) |
| ***C11D 7/14*** | (2006.01) |
| ***C11D 7/18*** | (2006.01) |
| ***C11D 7/38*** | (2006.01) |
| ***C11D 3/39*** | (2006.01) |
| ***C11D 7/06*** | (2006.01) |
| ***C11D 17/00*** | (2006.01) |
| ***B08B 3/04*** | (2006.01) |
| ***C11D 1/00*** | (2006.01) |
| ***C11D 3/04*** | (2006.01) |
| ***C11D 3/30*** | (2006.01) |
| ***C11D 3/20*** | (2006.01) |
| ***C11D 11/00*** | (2006.01) |
| ***B65D 81/32*** | (2006.01) |

(52) U.S. Cl.

CPC ..... *C11D 3/3942* (2013.01); *B08B 3/04* (2013.01); *B65D 81/32* (2013.01); *C11D 1/00* (2013.01); *C11D 3/04* (2013.01); *C11D 3/044* (2013.01); *C11D 3/2003* (2013.01); *C11D 3/2017* (2013.01); *C11D 3/2079* (2013.01); *C11D 3/30* (2013.01); *C11D 3/3902* (2013.01); *C11D 3/3947* (2013.01); *C11D 7/06* (2013.01); *C11D 7/12* (2013.01); *C11D 7/14* (2013.01); *C11D 11/0011* (2013.01); *C11D 11/0017* (2013.01); *C11D 11/0023* (2013.01); *C11D 11/0064* (2013.01); *C11D 17/00* (2013.01)

(58) Field of Classification Search

CPC .. C11D 17/00; C11D 7/12; C11D 7/14; C11D 3/3902; C11D 3/3942; C11D 3/3947; B08B 3/04

USPC ..... 510/303, 309, 372, 509, 511

See application file for complete search history.

(56) References Cited

U.S. PATENT DOCUMENTS

| | | | | |
|---|---|---|---|---|
| 6,440,920 | B1 * | 8/2002 | Ofosu-Asante | C11D 3/3947 510/372 |
| 6,566,323 | B1 * | 5/2003 | Littig | C11D 3/30 510/302 |
| 6,608,015 | B2 * | 8/2003 | Busch | C11D 3/168 510/311 |
| 9,476,014 | B2 * | 10/2016 | Galimi, II | C11D 7/06 |
| 2005/0232848 | A1 * | 10/2005 | Nguyen | A01N 59/00 423/473 |
| 2009/0239778 | A1 * | 9/2009 | Gentschev | C11D 3/30 510/223 |
| 2012/0097193 | A1 * | 4/2012 | Rossetto | C11D 3/39 134/25.2 |

FOREIGN PATENT DOCUMENTS

| | | | |
|---|---|---|---|
| EP | 1275708 | * | 1/2003 |
| WO | WO96/06912 | * | 3/1996 |

* cited by examiner

*Primary Examiner* — Gregory R Delcotto

(74) *Attorney, Agent, or Firm* — Maginot, Moore & Beck, LLP

(57) ABSTRACT

A product for cleaning a surface includes a combination of a first composition with a second composition. The first composition includes hydrogen peroxide and makes up 94-99.5% of the combination by weight. The second composition includes at least one of a silicate, a carbonate, a bicarbonate and a percarbonate and makes up 0.5-6% of the combination by weight. The first composition and the second composition are stored in separate vessels until combined to form the combination. The combination is applied to the surface after mixing.

16 Claims, No Drawings

PRODUCT FOR CLEANING SURFACES

PRIORITY CLAIM

This application claims priority to U.S. patent application Ser. No. 14/180,682, filed on Feb. 14, 2014, now U.S. Pat. No. 9,476,014, which claims priority to U.S. provisional patent application No. 61/764,654, filed on Feb. 14, 2013, the disclosures of which are incorporated herein by reference in their entireties.

BACKGROUND

This disclosure relates to a product for cleaning and removing stains, and more particularly to cleaning and removing stains from items that are exposed to the outdoors for extended periods of time.

The task of cleaning items has been practiced for centuries. In the context of cleaning a surface, cleaning involves solubilizing and removing impurities and undesirable materials from the surface without damaging the surface. In the context of cleaning surfaces that are exposed to the outdoors for extended periods of time, such as for example decks, docks, fences, patios, homes, boats, RVs, campers, and outdoor furnishings, a unique set of challenges is presented which differs from that of other cleaning processes. Outdoor items are made up of a variety of materials having exposed surfaces made of, for example wood, composites, concrete, brick, stone, stucco, grout, gelcoat, elastomerics, fiberglass, plastic, vinyl, metal, and a wide array of outdoor fabrics. Due to their exposure to outdoor elements, such surfaces are often stained by inorganic debris, organic matter, algae, mold and mildew, and by-products of microorganism metabolism. Prior cleaning processes fail to clean and remove stains from these outdoor items. A sufficient cleaning method for this task is one that can clean a variety of outdoor stains from a variety of outdoor surfaces.

One unique challenge presented by the task of cleaning outdoor items is the particular types of stains that are formed outdoors. Cleaning outdoor stains caused by mildews, molds, and algae from outdoor surfaces is fundamentally different than cleaning soap scum, lime or rust stains, calcium deposits, and biological proteins from indoor surfaces in kitchens and bathrooms or cleaning microbes and bacteria from lab settings or cleaning dust or grease build-up from industrial settings. Accordingly, the types of cleaners that are effective on these indoor stains and impurities are ineffective on outdoor stains and materials. Additionally, the environmental conditions that are present during formation of outdoor stains are fundamentally different than those during formation of indoor stains. Outdoor temperatures and UV light from sunlight set stains on outdoor substrates much more strongly than the temperatures and fluorescent or other lights that are present indoors.

Furthermore, the types of substrates on which these outdoor stains are formed often have different characteristics than indoor substrates. Substrates like wood and fabrics that are used in outdoor settings are generally more weathered than similar substrates used in indoor settings. Additionally, weather resistant outdoor substrates like brick, stone and concrete, generally have roughened surfaces not found indoors. The surface properties and textures of these outdoor substrates usually make them more difficult to clean than indoor substrates. Accordingly, prior cleaning products suitable for use on indoor items are generally ineffective for outdoor items due to the types of stains the environmental conditions during the formation of the stains, and the conditions of the substrates on which the stains are formed.

Prior cleaning processes which are used to clean roughened surfaces like pulps and textiles are also inappropriate for cleaning outdoor stains in an at-home setting. These prior cleaning processes often use harsh chemicals, which are too dangerous to be used at home, and require particular environmental conditions, such as heating the substrates to extremely high temperatures, during the cleaning process. Processes for bleaching wood pulp further include soaking individual wood fibers and other contaminants present in trees shortly after harvesting. Pulp bleaching processes can include three or four different stages of continuous cleaning and bleaching, with each stage involving different chemicals and reactions. Cleaning large items, such as decks, RVs, docks, patios, fences, boats, campers, homes, and outdoor furniture generally must occur in an outdoor open air setting. Accordingly, the cleaning process for outdoor items must not release certain hazardous chemicals and must be effective at a broad range of temperatures that occur in ambient outdoor settings.

Prior cleaning processes which are effective at cleaning laundry items are also ineffective at removing outdoor stains. Processes for cleaning laundry items include submerging the items in a cleaning composition and achieving heightened temperatures to activate the cleaning compositions. In contrast, cleaning outdoor items that have large surface areas requires a cleaning process that is effective without requiring the item to be submerged in a cleaning composition or maintained at certain temperatures.

Another unique challenge presented by the task of cleaning outdoor items is making a process that is achievable by a consumer in a home or commercial setting. Such a process should not damage the substrate to be cleaned or other surrounding items. The process should not require use of chemicals that are unsafe for consumer use or that are harmful to the environment. While bleaching compositions, such as sodium hypochlorite, are effective cleaners in some applications, they release chlorine which can infiltrate earth, air, and water, destroy plant life, and unintentionally ruin materials.

Additionally, the process should be easy for users to prepare and perform in home and commercial settings. One way to facilitate ease of use by consumers is for the process to include compositions provided in a single package that can be stored without degrading or reacting with one another. Prior cleaning products and processes that use particular chemicals and compositions are inappropriate for consumer use due to their hazardous properties, their undesirable side effects, and their difficulty of use. Accordingly, there is a need for a cleaning process which is effective on stains on outdoor items, that does not harm the environment, and that is easily applied by consumers.

SUMMARY

The present disclosure addresses the need for a product for cleaning that is effective at removing dirt and stains from outdoor items. The cleaning product utilizes two compositions which react with one another and generate gases when combined. Accordingly, the compositions are stored in separate vessels until the time they are to be used. After combination, the compositions are applied to a surface to react with contaminants to remove dirt and stains from the surface. The first composition is an oxygen donor and the second composition is an activator. The combination of the first and second compositions is more effective at removing dirt and stains than is either of the compositions alone or either of the compositions combined solely with water.

After combining, the oxygen donor and the activator are mixed together before being applied to the surface. Once the oxygen donor and the activator are combined, there is a limited amount of time during which the combination is able to effectively clean a surface to which it is applied. In at least one embodiment, the oxygen donor and activator no longer effectively clean the surface if applied seven days after combination. Once the combination is applied to the surface, contact must be maintained between the combination and the surface before rinsing the combination off the surface. In at least one embodiment, contact should be maintained for up to thirty minutes before rinsing.

According to a preferred embodiment, the first composition includes hydrogen peroxide and makes up 94-99.5% of the combination by weight and the second composition includes at least one of a silicate, a carbonate, a bicarbonate, and a percarbonate and makes up 0.5-6% of the combination by weight. The second composition can be selected, at least in part, based on properties of the outdoor surface to be cleaned.

According to a preferred embodiment, the first composition includes an amount of active component having a first weight and the second composition includes an amount of active component having a second weight. In this embodiment, the ratio of the first weight to the second weight is in a range of 1:1 to 30:1.

DETAILED DESCRIPTION

The compositions include a first composition, or an oxygen donor, and a second composition, or an activator, which causes the oxygen donor to release oxygen when the two compositions are combined. In other words, the combination of the oxygen donor and activator form an oxygen species, as well as peroxycarbonate and peroxysilicate compounds. Different oxygen species have different properties and by-products, some of which are suited to cleaning particular surfaces. The particular chemical make-up of the oxygen donor, along with the particular chemical make-up of the activator, determines what particular oxygen species is formed.

In the present method of cleaning, the preferred oxygen donor is hydrogen peroxide ($H_2O_2$) and is most preferably aqueous hydrogen peroxide. In preferred embodiments, the aqueous hydrogen peroxide has approximately 7.5% active hydrogen peroxide with the remainder (92.5%) water. However, the aqueous hydrogen peroxide can have between 4 and 50% active hydrogen peroxide, with the remainder water. The aqueous hydrogen peroxide typically has a pH of 3-5.

While other oxygen donors can generate oxygen species suitable for other applications, none are as suitable for use in cleaning outdoor surfaces as hydrogen peroxide. For example, peroxyacetic acid, while capable of generating an effective antimicrobial for hard indoor surfaces, such as those in medical and food related settings, does not generate an oxygen species that is effective at cleaning outdoor surfaces. Additionally, peroxyacetic acid can be highly corrosive and long term exposure can cause physical damage. Sodium percarbonate is capable of generating oxygen species that are used effectively as a mild bleach in clothing and laundry applications. But, like peroxyacetic acid, sodium percarbonate also does not generate oxygen species effective for removing outdoor stains.

The activator can include one or more activation components which are selected from a group including silicates, percarbonates, carbonates, and bicarbonates. Because the activation components react differently with the hydrogen peroxide, the type of activation components can be selected based on the type surface to be cleaned and the type of contaminant to be removed. Preferably, the activator includes two activation components selected to most effectively address the type surface to be cleaned and the type of contaminant to be removed. Most preferably, the activator includes some amount of sodium metasilicate ($Na_2SiO_3$). In some embodiments, the activator includes sodium metasilicate and potassium carbonate ($K_2CO_3$). However, the activator can include any of sodium metasilicate, potassium carbonate, and sodium percarbonate ($Na_2CO_3$—$H_2O_2$), either alone or in combination, depending on the surface and contaminant.

Because the combination of the hydrogen peroxide and activator results in a gas-releasing reaction, the two compositions must be stored in separate vessels until time of use. Accordingly, it is impractical to package, ship, and/or store the two compositions in a single vessel. Thus, the hydrogen peroxide is contained within a first vessel and the one or more activation components that make up the activator are contained within a single, second vessel. In various embodiments, the hydrogen peroxide and activator can both be provided as a liquid or as a powder, or one can be a liquid and the other a powder. In a preferred embodiment, the hydrogen peroxide is provided as a liquid and the activator is provided as a powder.

By way of example, for porous surfaces, such as wood or stucco, an activator that is mostly made up of a silicate is most effective. An activator that is mostly made up of a silicate is also most effective for surfaces contaminated with algae. For outdoor fabrics and textiles, such as patio umbrellas and outdoor furniture cushions, an activator including less silicate and more carbonate is most effective. For items made up of multiple types of surfaces, such as an RV or a boat which often includes gel-coat, glass and metal surfaces, an activator with silicate will leave a silica scale on glass and metal portions. Accordingly, for items made up of multiple surfaces including glass and metal, an activator including less silicate and more carbonate is effective and reduces scale. For smooth, hard surfaces, such as the elastomeric surface of an RV roof, an activator including some silicate is most effective.

The combination of the hydrogen peroxide and activator is more effective at removing dirt and stains than is any of the components or compositions alone or any of the components or compositions combined solely with water. After combining, the hydrogen peroxide and the activator are mixed together before being applied to the surface. In at least one embodiment, the hydrogen peroxide and the activator are mixed together for five to ten minutes before being applied to the surface. Once the hydrogen peroxide and the activator are combined, there is a limited amount of time during which the combination is able to effectively clean a surface to which it is applied. In at least one embodiment, the hydrogen peroxide and activator no longer effectively clean the surface if applied seven days after combination. Accordingly, in at least one embodiment it is preferable to apply the hydrogen peroxide and activator to the surface within twenty four hours of combining. In some embodiments, it is most preferable to apply the combination within two hours of combining. Once the combination is applied to the surface, contact must be maintained between the combination and the surface before rinsing the combination off the surface. In at least one embodiment, contact should be maintained for at least five minutes before rinsing. In another embodiment, contact should be maintained for up to thirty minutes before rinsing.

The hydrogen peroxide and the activator each have a weight, and when combined, the resulting combination has a combined weight. Accordingly, the weights of the hydrogen peroxide and activator are percentages of the combined weight. The weight of the hydrogen peroxide is 94-99.5% of the combined weight and the weight of the activator is 0.5-6% of the combined weight. In a preferred embodiment, the weight of the hydrogen peroxide is 97-98.5% of the combined weight and the weight of the activator is 1.5-3% of the combined weight. Within these weight percentage ranges, the ratio of the weight of the hydrogen peroxide to the activator is between 16:1 and 64:1. In a preferred embodiment, the ratio of the weight of the hydrogen peroxide to the activator is 32:1.

Within the hydrogen peroxide, which is preferably aqueous hydrogen peroxide, a percentage of the weight of the hydrogen peroxide is made up of active hydrogen peroxide and the remainder of the weight of the hydrogen peroxide is made up of water. Additionally, commercially available solutions of aqueous hydrogen peroxide may also contain small amounts of undisclosed stabilizers, which are not separately addressed in the content of this application. The weight percentage of active hydrogen peroxide is 4-50%, but in a preferred embodiment, the weight percentage of active hydrogen peroxide is 7.5%.

Similarly, within the activator, a percentage of the weight of the activator is made up of active components and the remainder of the weight of the activator is made up of water. Preferably, the activator is anhydrous such that the weight percentage of active components is 97-99.5% and the weight percentage of water is 0.5-3%. However, the activator can also be aqueous such that the weight percentage of active components is 20-99.5% and the weight percentage of water is 0.5-80%. In embodiments where the activator includes two activation components, the combined weight percentages of the active components of both activation components is 20-99.5% and is preferably 97-99.5%. The ratio of the two activation components, and of the active components thereof, depends on the type of surface to be cleaned and the type of contamination to be removed.

Depending upon the weight percentages of the hydrogen peroxide and activator within the combination and upon the weight percentages of the active components within the hydrogen peroxide and activator, the ratio of active components of the hydrogen peroxide to active components of the activator is in a range of 1:1 to 30:1. The particular ratio of the weight percentages of the hydrogen peroxide and activator and the particular ratio of active components of the hydrogen peroxide and activator depends on which activation components are included in the activator and on the type of surface to be cleaned and the type of contamination to be removed.

In some embodiments, water is added to the combination of the hydrogen peroxide and activator. In particular, when the combination includes hydrogen peroxide having a weight percentage of active hydrogen peroxide that is greater than 7.5%, water can be used to dilute the combination to reduce the weight percentage of active hydrogen peroxide relative to the total weight of the combination. Additionally, when water is added to the combination, the weight percentage(s) of active components of the activator composition is(are) increased to achieve the desired weight percentage of active component(s) relative to the total weight of the combination. Water can also be added to the combination to produce a greater amount of the combination in a diluted form. This diluted form of the combination can be used to clean a larger surface area with a less effective cleaning composition.

A first example of a composition, based on a composition weight of 100 g, for use in the disclosed method of cleaning is shown below:

Example #1

97.5 g of oxygen donor including 7.5% $H_2O_2$ and 92.5% $H_2O$ 2.5 g of activator including 97.5% $Na_2SiO_3$ and 2.5% $H_2O$ In this example, the ratio of the weight percentage hydrogen peroxide to the weight percentage activator is within the range of 16:1 and 64:1, namely 39:1, and the ratio of the weight percentage of active components within the hydrogen peroxide and the activator is within the range of 1:1 and 30:1, namely 3:1. This example is particularly effective at cleaning porous surfaces, such as wood.

A second example of a composition, based on a composition weight of 100 g, for use in the disclosed method of cleaning is shown below:

Example #2

95 g of oxygen donor including 15% $H_2O_2$ and 85% $H_2O$ 5 g of activator including 97.5% $Na_2SiO_3$ and 2.5% $H_2O$ In this example, the ratio of the weight percentage hydrogen peroxide to the weight percentage activator is within the range of 16:1 and 64:1, namely 19:1, and the ratio of the weight percentage of active components within the hydrogen peroxide and the activator is within the range of 1:1 and 30:1, namely approximately 2.9:1. In this example, the hydrogen peroxide includes 15% active hydrogen peroxide. Accordingly, the amount of activator is increased to maintain the ratio of weight percentage of active components within the hydrogen peroxide and the activator. Additionally, in this example, an additional 100 g of water is mixed with the combination of the hydrogen peroxide and activator. When this water is added to the composition, the ratio of the weight percentage hydrogen peroxide to the weight percentage activator is maintained at 19:1 and the ratio of active components within the hydrogen peroxide and the activator remains the same, but the hydrogen peroxide is diluted by the water back to around 7.5% active relative to the weight of the combination including the water. This example demonstrates that different formulations of hydrogen peroxide can be used in the oxygen donor and diluted with water when the oxygen donor is combined with the activator to produce an effective composition within the parameters of the invention.

A third example of a composition, based on a composition weight of 100 g, for use in the disclosed method of cleaning is shown below:

Example #3

97.5 g of oxygen donor including 7.5% $H_2O_2$ and 92.5% $H_2O$ 2.5 g of activator including 79% $K_2CO_3$, 19% $Na_2SiO_3$, and 2% $H_2O$ In this example, the ratio of the weight percentage hydrogen peroxide to the weight percentage activator is within the range of 16:1 and 64:1, namely 39:1, and the ratio of the weight percentage of active components within the hydrogen peroxide and the activator is within the range of 1:1 and 30:1, namely approximately 2.98:1. This example is particularly effective at cleaning smooth elastomeric surfaces, such as RV roofs.

Additional examples of effective combinations of hydrogen peroxide and activators are listed in Table 1.

TABLE 1

| % active $H_2O_2$ | Activator component 1 | % active | Activator component 2 | % active |
|---|---|---|---|---|
| 7.5 | $K_2CO_3$ | 2.5 | n/a | 0 |
| 7.5 | $K_2CO_3$ | 1.5 | $Na_2SiO_3$ | 1.0 |
| 7.5 | $Na_2SiO_3$ | 1.5 | $K_2CO_3$ | 1.0 |
| 7.5 | $Na_2SiO_3$ | 2.0 | $K_2CO_3$ | 0.5 |
| 7.5 | $Na_2SiO_3$ | 2.0 | $Na_2CO_3$ | 0.5 |
| 7.5 | $Na_2CO_3$ | 5.0 | n/a | 0 |
| 7.5 | $Na_2CO_3$—$H_2O_2$ | 2.5 | n/a | 0 |
| 7.5 | $Na_2CO_3$—$H_2O_2$ | 2.0 | $Na_2SiO_3$ | 0.5 |
| 7.5 | $Na_2CO_3$—$H_2O_2$ | 1.5 | $Na_2SiO_3$ | 1.0 |
| 7.5 | $Na_2SiO_3$ | 1.5 | $Na_2CO_3$—$H_2O_2$ | 1.0 |
| 7.5 | $Na_2SiO_3$ | 2.0 | $Na_2CO_3$—$H_2O_2$ | 0.5 |
| 7.5 | $Na_2SiO_3$ | 1.0 | n/a | 0 |
| 7.5 | $Na_2SiO_3$ | 3.75 | n/a | 0 |

In an exemplary embodiment of the method, after the hydrogen peroxide and activator are combined and water is optionally added, the combination is mixed for at least five to ten minutes for homogenization. Once the hydrogen peroxide and activator are combined, they begin to react with one another to form the oxygen species immediately. Because the reaction and formation of the oxygen species is what enables the combination to clean outdoor surfaces, the combination must be used before the reaction is completed. Accordingly, in this embodiment, the combination is applied to the surface within twenty four hours of mixing the compositions, and preferably within two hours of mixing the compositions. For this reason also, the hydrogen peroxide and activator are kept in separate vessels until the time of combination and cannot be packaged, shipped and/or stored in a single vessel.

It will be understood that the combination of hydrogen peroxide and activator can also be diluted with an equal part of water once the hydrogen peroxide and activator are mixed. In such embodiments, the resulting diluted combination can be used to clean surfaces that are lightly soiled and can be used to clean greater surface areas. It will also be understood that the amount of active components of the oxygen donor and/or activator in the combination can be doubled. In such embodiments, the resulting combination can be used to clean more heavily soiled surfaces, but will not spread over greater surface areas.

After mixing, the combination can be applied to the surface to be cleaned by spraying, misting, pouring, sprinkling, or otherwise distributing an amount of the combination on the surface such that the surface is substantially and evenly covered with the combination. Due to the ongoing reaction between the compositions, the combination produces foam on the surface. The reaction can take place at an ambient temperature, such as, for example, 5-40 degrees Celsius. In this exemplary embodiment, approximately fifteen minutes after applying the combination to the surface, the combination is agitated on the surface to ensure complete coverage of the surface and uniform contact of the combination with the surface. For example, the combination can be brushed on a deck surface using a stiff broom or can be wiped on a smooth RV surface using a sponge.

While agitating the combination on the surface, an additional amount of the combination can be applied, if necessary, to the surface to keep the surface wet with foam. In this exemplary embodiment, approximately fifteen minutes after agitating the combination and/or adding an additional amount of the combination to the surface, the combination is rinsed off the surface with water to complete the method. For example, the combination can be rinsed off the surface with a light pressure washing using a wide spray and 1200 psi.

One advantage of this composition and method is that the oxygen donor and activator include chemicals which form particular oxygen species capable of removing outdoor stains from a variety of outdoor surfaces. It will be understood, however, that embodiments of the composition and method may also be utilized to remove unwanted impurities and debris from indoor surfaces. Another advantage of this composition and method is that it uses compositions which are environmentally friendly and biodegradable. Because this method uses oxygen production instead of bleaching or other chemical processes which release harmful byproducts, this method is sustainable and is well suited for application by a consumer in a home or commercial setting.

While the composition and method for cleaning has been described in detail in the foregoing description, the same should be considered as illustrative and not restrictive in character. It is understood that only the preferred embodiments have been presented and that all changes, modifications and further applications that come within the spirit of the invention are desired to be protected.

What is claimed is:

1. A product for cleaning a surface, the product consisting of:

a combination, consisting of:

a first composition consisting of hydrogen peroxide as an active component of the first composition and water, wherein 94-99.5% of the combination by weight is the first composition; and a second composition consisting of at least one of a silicate, a carbonate, a bicarbonate, and a percarbonate as an active component of the second composition and water, wherein 0.5-6% of the combination by weight is the second composition.

2. The product of claim 1, wherein:

the active component of the second composition is silicate, which is present in an effective amount to clean a porous surface.

3. The product of claim 1, wherein:

the active component of the second composition is at least one of carbonate, percarbonate, and bicarbonate, which is present in an effective amount to clean a fabric or textile surface.

4. The product of claim 1, wherein:

the active component of the second composition is at least one of carbonate, percarbonate, and bicarbonate, which is present in an amount sufficient to clean a smooth, hard surface.

5. The product of claim 1, wherein:

the combination consists of a weight ratio of the first composition to the second composition of approximately 16:1 to approximately 64:1.

6. The product of claim 5, wherein:

the weight ratio of the first composition to the second composition is approximately 32:1.

7. The product of claim 1, wherein:

the first composition is 97-98.5% of the combination by weight; and the second composition is 1.5-3% of the combination by weight.

8. The product of claim 1, wherein:

the active component of the first composition has a first weight;

the active component of the second composition has a second weight; and the ratio of the first weight to the second weight is between 1:1 and 30:1.

9. The product of claim 1, wherein:

the second composition has a composition weight and the active component of the second composition has an active weight that is 20-99.5% of the composition weight.

10. The product of claim 9, wherein:

the active component of the second composition is sodium metasilicate.

11. The product of claim 10, wherein:

the active component of the second composition is $SiO_2$ and $Na_2O$ in a weight ratio of 1:1 to 3.22:1.

12. The product of claim 9, wherein:

the active component of the second composition is potassium carbonate.

13. The product of claim 9, wherein:

the active component of the second composition is sodium percarbonate.

14. The product of claim 9, wherein:

the second composition has a first active component and a second active component, each of which has an active weight, and the active weight of the first active component combined with the active weight of the second active component is 20-99.5% of the composition weight.

15. The product of claim 14, wherein:

the first active component is present in an amount of 0.25-3% of the combination by weight; and the second active component is present in an amount of 0.25-3% of the combination by weight.

16. The product of claim 14, wherein:

the first active component is sodium metasilicate; and the second active component is potassium carbonate.

* * * * *